US005820347A

United States Patent [19]

Bussonnet et al.

[11] Patent Number: 5,820,347

[45] Date of Patent: Oct. 13, 1998

[54] RESTRAINING DEVICE FOR THE ROOT OF A FAN BLADE

[75] Inventors: Pierre Xavier Bussonnet, Sucy en Brie; Jack Pierre Lauvergnat, Savigny le Temple, both of France

[73] Assignee: Societe Nationale d'Etude et de Construction de Moteurs d'Aviation "Snecma", Paris, France

[21] Appl. No.: 818,941

[22] Filed: Mar. 17, 1997

[30] Foreign Application Priority Data

Mar. 21, 1996 [FR] France ..... 96 03497

[51] Int. Cl.[6] ..... F01D 5/32

[52] U.S. Cl. ..... 416/221; 416/248; 416/500

[58] Field of Search ..... 416/219 R, 220 R, 416/221, 248, 500

[56] References Cited

U.S. PATENT DOCUMENTS

| | | | |
|---|---|---|---|
| 3,216,699 | 11/1965 | Schoenborn | 416/500 |
| 3,572,970 | 3/1971 | Smuland | 416/221 |
| 3,910,719 | 10/1975 | Hessler et al. | 416/219 R |
| 5,123,813 | 6/1992 | Przytulski et al. . | |
| 5,236,309 | 8/1993 | Van Heusden et al. . | |
| 5,282,720 | 2/1994 | Szpunar . | |

FOREIGN PATENT DOCUMENTS

| | | |
|---|---|---|
| 3236021 A1 | 5/1983 | Germany . |

*Primary Examiner*—Christopher Verdier

*Attorney, Agent, or Firm*—Oblon, Spivak, McClelland, Maier & Neustadt, P.C.

[57] ABSTRACT

A packing member for restraining the root of a fan blade in a socket of a rotor disk takes the form of a curvilinear plate comprising a metallic sub-structure having recessed portions and a semi-rigid elastomeric material molded into and filling the recessed portions. The member has a substantially metallic central area extending as far as the side edge of the member on the same side as the extrados face of the blade, the metallic central area having a machined profile set back relative to the profile of the socket so as to permit the root of the blade to rock in response to a violent impact on the blade. The packing member has upstream and downstream end areas which are entirely metallic, and the two side edges of the member upstream and downstream of the central area are defined by the elastomeric material. Between the two elastomeric side edges, both upstream and downstream of the metallic central area, the member has a metallic lower part and an upper part formed by the elastomeric material.

5 Claims, 1 Drawing Sheet

RESTRAINING DEVICE FOR THE ROOT OF A FAN BLADE

BACKGROUND OF THE INVENTION

1. Field of the Invention

The invention relates to a device for restraining the root of a fan blade in a socket of a rotor disk in which the root is received to mount the blade on the disk.

Fan blades of a turbojet engine are generally mounted with a clearance in sockets provided in the rim of a rotor disk, and are held radially in position by packing members inserted into the sockets under the blade roots. Fixing means are provided upstream and downstream of the disk to prevent axial displacement of the blades.

During autorotation of the blades on stopping the engine, or at a low rotational speed of the rotor, the centrifugal force exerted on the blades is not sufficient to keep the roots of the blades radially in place. As a result the blades are able to rock in the sockets, causing clatter and premature wear of the contacting surfaces.

2. Summary of the Prior Art

To remedy this defect and limit the clearances and vibrations, various configurations for the packing members have been proposed, such as a springy metal blade or a torsion bar. However, for damping of the blade vibrations to be effective, it is necessary that each packing member should be in close contact with the root of the respective blade and exert a substantial force against the root. Moreover, in the event of extreme stress due, for example, to bird ingestion tests or to impact on a blade resulting from the breakage of an adjacent blade, the leading edge and the intrados face of the struck blade may suffer very substantial damage which could lead to the breakage of this blade at its base. To avoid the struck blade breaking under the action of the shock, the packing member must allow some rotation of the root of the struck blade.

SUMMARY OF THE INVENTION

The aim of the invention is to solve the above problem and to provide a device for restraining the root of a blade which will damp vibrations of the blade, prevent rocking of the root when the centrifugal forces are low, and permit some rotation of the root so as to prevent breakage of the blade at its base in response to an extreme force exerted on the blade.

To that end, according to the invention, there is provided a device for restraining the root of a fan blade in a socket of a rotor disk in which said root is received to mount said blade on said rotor disk, said fan blade having two sides termed the intrados and extrados faces of the blade, and said restraining device comprising a packing member for insertion into said socket under said root of the blade, said packing member taking the form of a curvilinear plate having a longitudinal axis and comprising a metallic sub-structure having recessed portions and a semi-rigid elastomeric material moulded into and filling said recessed portions, said packing member having a substantially metallic central area extending to a side edge of said packing member on the same side as said extrados face of said blade.

Preferably the metallic central area of said packing member has a machined profile set back relative to the profile of said socket. This facilitates rotation of the root in response to a violent impact on the blade. In the preferred embodiment the upstream and downstream end areas of the packing member are entirely metallic, and the two side edges upstream and downstream of the metallic central area are defined by the elastomeric material. Between the two elastomeric side edges, both upstream and downstream of the metallic central area, the packing member has a metallic lower part and an elastomeric upper part.

Other preferred features and advantages of the invention will become apparent from the following description of the preferred embodiment, given by way of example, with reference to the attached drawings.

DESCRIPTION OF THE PREFERRED EMBODIMENT

Figure 1:
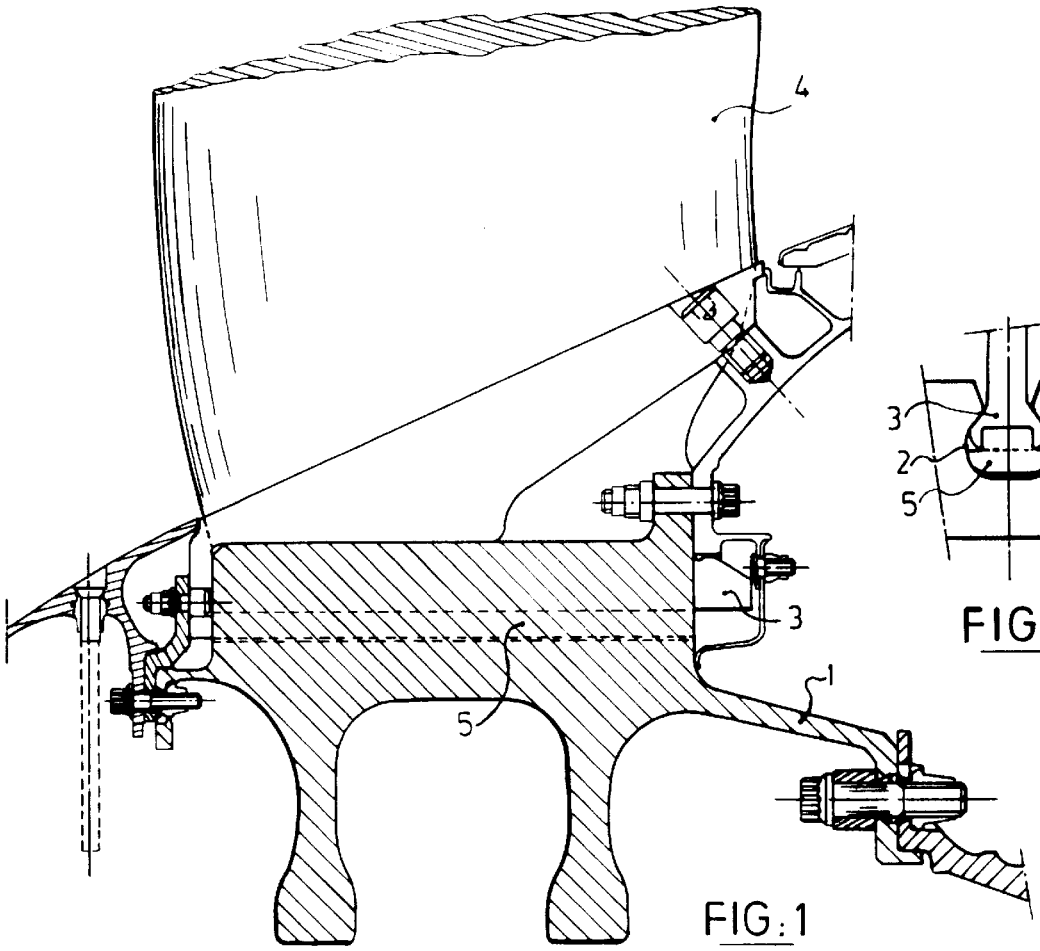
FIG. 1 is a sectional view in an axial plane, showing the root of a fan blade secured in a socket in the rim of a rotor disk.
Figure 2:
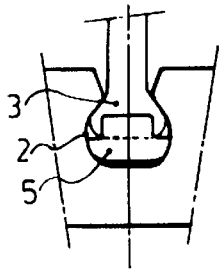
FIG. 2 is an end view showing the blade root housed in the socket and restrained radially by a packing member in accordance with the invention.

In FIGS. 1 and 2 a fan rotor disk is shown having a rim provided with substantially axially directed sockets or grooves 2 for receiving the roots 3 of the fan blades 4. The sockets 2 and the roots 3 are dovetail shaped, and each blade root is axially slidable into its respective socket 2.

Inserted between the root 3 of each blade 4 and the bottom of its socket 2 is a resilient packing member 5 which holds the root 3 against the walls of the socket 2.

Figure 3:
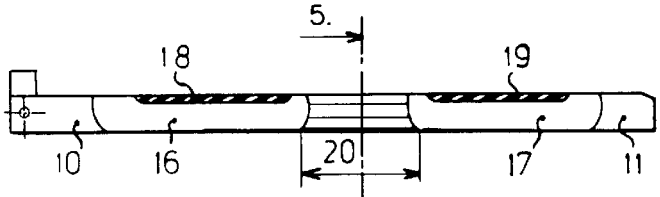
FIG. 3 is a longitudinal section through a preferred embodiment of the packing member in accordance with the invention.
Figure 5:
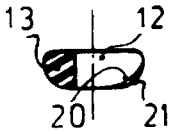
FIG. 5 is a sectional view of the packing member along line A—A of FIG. 3.
Figure 4:
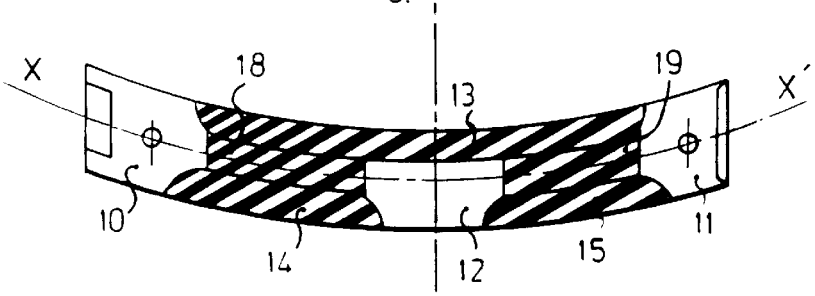
FIG. 4 is a top plan view of the packing member shown in FIG. 3.

In the embodiment shown in FIGS. 3, 4 and 5, the packing member 5 is in the form of a curvilinear plate, of longitudinal axis XX', comprising a metallic sub-structure having recessed portions filled by the moulding of a semi-rigid elastomeric material of polyurethane type.

The packing member has upstream and downstream end areas 10 and 11 which are entirely metallic, and a central area 12 which is substantially metallic and extends to the side edge of the member on the same side as the extrados face of the blade.

Between the two end areas 10 and 11, the side edges of the packing member are formed by elastomeric material 13,14, 15 except where the metallic central area 12 forms part of the side edge on the extrados side. Along the longitudinal axis XX' between the two side edges, upstream and downstream of the metallic central part 12, the packing member has a metallic lower part 16,17 and an elastomeric upper part 18,19.

On the side edge of the packing member on the extrados side, the metallic central area 12 has a machined profile 20 which is set back relative to the profile 21 of the elastomeric portions 14,15 upstream and downstream of the central area 12. In the event of a violent impact on the blade, the set back profile permits a torsional deformation of the metallic central part 12 of the packing member as a result of the torsional couple produced by the impact on the blade. The deformation of the packing member occurs on the extrados side and permits a limited rotation of the root of the blade, thereby reducing the risk of breakage of the blade in the region of the attachment of the root to the disk.

The moulding of the elastomeric material on the packing member is effected so that it is slightly proud of the metallic sub-structure. The elasticity of the elastomeric material then enables the packing member 5 to be fitted with a slight compression under the root 3 of the blade 4 to eliminate the residual clearance between the member and the root in the socket 2 of the disk 1. The member thus holds the root 3 of the blade 4 in the proper position thanks to the rigidity of the metallic upstream and downstream end areas 10,11 in association with the overthickness of elastomeric material of polyurethane type.

In the event of extreme stress, such as the impact on a blade resulting from the loss of an adjacent blade or the ingestion of a bird, the packing member 5 is able to absorb part of the stress imposed on the impacted blade thanks to the set back profile 20 of the metallic central area 12. The positioning of the blade is restored after the shock.

The improvement of the vibratory situation of the blades is achieved thanks to the elastomeric part of the packing member. Under the action of centrifugal force, this elastomeric part deforms and applies itself under the roots of the blades.

We claim:

1. A device for restraining a root of a fan blade in a socket of a rotor disk in which said root is received to mount said blade on said rotor disk, said fan blade having two sides termed intrados and extrados faces of the blade, and said restraining device comprising a packing member for insertion into said socket under said root of the blade, said packing member taking the form of a curvilinear plate having a longitudinal axis and comprising a metallic substructure having recessed portions and a semi-rigid elastomeric material moulded into and filling said recessed portions, said packing member having a substantially metallic central area extending to a side edge of said packing member on the same side as said extrados face of said blade.

2. A restraining device according to claim 1, wherein said metallic central area of said packing member has a machined profile set back relative to the profile of said socket.

3. A restraining device according to claim 1, wherein said packing member has upstream and downstream end areas which are entirely metallic.

4. A restraining device according to claim 1, wherein the two side edges of said packing member are defined by said elastomeric material upstream and downstream of said metallic central area.

5. A restraining device according to claim 4, wherein said packing member has a metallic lower part and an elastomeric upper part between said elastomeric side edges both upstream and downstream of said metallic central area.

* * * * *